US008556101B2

(12) United States Patent
Delatour et al.

(10) Patent No.: US 8,556,101 B2
(45) Date of Patent: Oct. 15, 2013

(54) PACKAGING DEVICE FORMING A CONTAINER

(76) Inventors: Thierry Delatour, Nouzonville (FR); Gilles Cardoso, Charleville-Mezieres (FR)

( * ) Notice: Subject to any disclaimer, the term of this patent is extended or adjusted under 35 U.S.C. 154(b) by 40 days.

(21) Appl. No.: 13/375,662

(22) PCT Filed: Jun. 1, 2010

(86) PCT No.: PCT/FR2010/051064
§ 371 (c)(1),
(2), (4) Date: Dec. 1, 2011

(87) PCT Pub. No.: WO2010/139891
PCT Pub. Date: Dec. 9, 2010

(65) Prior Publication Data

US 2012/0067876 A1 Mar. 22, 2012

(30) Foreign Application Priority Data

Jun. 2, 2009 (FR) ..... 09 02640

(51) Int. Cl.
*B65D 25/00* (2006.01)

(52) U.S. Cl.
USPC ..... 220/9.4; 220/4.28

(58) Field of Classification Search
USPC ..... 220/4.28, 9.4, 4.31, 6, 9.1, 9.2, 9.3, 7, 220/495.06; 383/4; 206/423
See application file for complete search history.

(56) References Cited

U.S. PATENT DOCUMENTS

| | | | | | |
|---|---|---|---|---|---|
| 1,467,690 | A | * | 9/1923 | Schwarz | 206/315.1 |
| 1,490,026 | A | * | 4/1924 | Richards | 47/41.01 |
| D117,833 | S | * | 11/1939 | Laine | D9/423 |
| 2,719,413 | A | * | 10/1955 | Panzer | 220/575 |
| 2,731,997 | A | * | 1/1956 | Muth et al. | 383/4 |
| 3,818,633 | A | * | 6/1974 | Sable | 47/67 |
| 4,678,095 | A | * | 7/1987 | Barnett et al. | 220/4.21 |
| 4,801,014 | A | * | 1/1989 | Meadows | 206/423 |
| 5,005,760 | A | * | 4/1991 | van den Hoogen | 229/125.38 |
| 5,033,232 | A | * | 7/1991 | Vaughn | 47/72 |
| 5,400,905 | A | * | 3/1995 | Lapalud et al. | 206/423 |
| 5,518,313 | A | * | 5/1996 | McAdam | 383/4 |
| 5,561,894 | A | * | 10/1996 | Weder et al. | 29/450 |
| 5,572,826 | A | * | 11/1996 | Weder | 47/41.12 |
| 5,752,649 | A | * | 5/1998 | Weder | 229/117.01 |
| 5,878,945 | A | * | 3/1999 | Weder | 229/117.01 |
| 5,967,360 | A | * | 10/1999 | Cheng-Tien | 220/489 |

(Continued)

*Primary Examiner* — Anthony Stashick
*Assistant Examiner* — Christopher McKinley
(74) *Attorney, Agent, or Firm* — Dennemeyer & Assoc. LLC.

(57) ABSTRACT

A packaging device forming a container, comprising a formable rigid structural element (6) joined to a sheet of flexible material (3) provided at the periphery with means for retaining a clamping tie (4). The rigid structural element (6) has a first part (5) which comprises a multiplicity of radial branches (50), which are made of flexible material, and a second part (7) made of rigid material, which has at its periphery radial arms (71), which are designed to define the shape and the volume of the container and which each have an end part which diverges from the plane of a central planar part (70) by flaring. The first and second parts (5, 7) are provided with means (53) for securing to one another such that they are coaxial with one another and such that the branches (50) are in line with the arms (71); while at one of the faces the flexible sheet (3) is secured to the first part (5) by its face opposite the face intended to accommodate the second part (7).

13 Claims, 4 Drawing Sheets

(56) References Cited

U.S. PATENT DOCUMENTS

| | | | | |
|---|---|---|---|---|
| 6,267,241 | B1 * | 7/2001 | Garcia et al. | 206/423 |
| 6,478,177 | B2 * | 11/2002 | Weder et al. | 220/9.4 |
| 6,601,367 | B1 * | 8/2003 | Weder et al. | 53/397 |
| 6,777,044 | B1 * | 8/2004 | Jeandemange et al. | 428/34.5 |
| 6,907,991 | B2 * | 6/2005 | Charrin et al. | 206/423 |
| 6,915,606 | B2 * | 7/2005 | Lantier et al. | 47/65.8 |
| 6,938,320 | B2 * | 9/2005 | Weder | 29/458 |
| 7,938,262 | B1 * | 5/2011 | Havive et al. | 206/423 |
| 2004/0099557 | A1 * | 5/2004 | Lesk et al. | 206/423 |
| 2005/0056643 | A1 * | 3/2005 | Hagan et al. | 220/9.3 |
| 2006/0026896 | A1 * | 2/2006 | Flanagan et al. | 47/41.01 |
| 2007/0007165 | A1 * | 1/2007 | Weder | 206/584 |
| 2007/0289212 | A1 * | 12/2007 | Shein | 47/65.8 |
| 2009/0130345 | A1 * | 5/2009 | Anderson et al. | 428/13 |
| 2009/0227454 | A1 * | 9/2009 | Jaiswal | 504/114 |
| 2011/0219691 | A1 * | 9/2011 | Alcazar et al. | 47/66.7 |

* cited by examiner

PACKAGING DEVICE FORMING A CONTAINER

The present invention relates to a packaging device made up of a set of flexible and rigid materials, shaped and maintained through the tightening of a tie, making it possible to produce a vase intended to receive a bouquet of flowers.

Packaging devices of this type are already known, in particular that described in document FR 2 789 052. The implementation of this type of packaging forming a container requires a series of operations: cutting decorative and sealing films, placing a plastic frame, possibly adhered at the central portion thereof (called support base) on one of the films, and preparing a tie to bind the assembly.

The production of the container is all the more difficult to do inasmuch as the operator must fold sheets and framework toward the top of the bouquet, bind the whole while maintaining the assembly. This operation also often requires the help of an extra person or the use of personal techniques to make this type of bouquet alone.

Also known from document U.S. Pat. No. 5,518,313 is a packaging device forming a container, comprising an element with a formable rigid structure, joined with a sheet of flexible material provided at the periphery with means for retaining a clamping tie, but this packaging device only allows the formation of parallelepiped packaging, and in no case does it make it possible to produce round or other, similar shapes, and furthermore it is not adapted to allow that packaging to be suitable for use as a vase.

The packaging device that is the subject-matter of the present invention aims to resolve these various drawbacks, in particular in that it:

- facilitates implementation of the container, simple and fast for a single operator, even an inexperienced one,
- proposes several container shapes,
- allows a more esthetic, harmonious and regular forming of the container,
- keeps all of the current technical advantages and comes close to their cost (portable bouquet, disposable vase, etc.).

The packaging device forming a container according to the invention comprises a formable rigid structural element joined to a sheet of flexible material provided at the periphery with means for retaining a clamping tie, and it is essentially characterized in that said rigid structural element has two parts, a first part that comprises a multiplicity of radial branches, and which is made from a material allowing said branches to be cinched, and a second part made of rigid material, which centrally has a flat portion and at its periphery radial aims of which there are fewer than or the same number as said branches, said radial aims, which are shorter than said branches, are designed to define the shape and volume of the container and to that end they each have an end part which diverges from the plane of a central planar part by flaring, said first and second parts being provided with means for securing to one another such that they are coaxial with one another, and such that said branches are in line with said arms; and in that at one of the faces the flexible sheet is secured to said first part by its face opposite that intended to accommodate the second part.

According to one additional feature of the packaging device according to the invention, the flexible sheet is made from a watertight material.

According to another additional feature of the packaging device according to the invention, it also includes at least one second sheet of flexible material, secured to the first sheet, on the face opposite that which is secured to the first part of the rigid structural element.

According to another additional feature of the packaging device according to the invention, the second sheet is secured to the first sheet so as to form, on the periphery of said first sheet, a sheath intended to make up the means for retaining a clamping tie.

According to one alternative of the packaging device according to the invention, the branches of the first part of the rigid structural element each include, near their end, a transverse conduit constituting one of the retaining means of the clamping tie.

According to another additional feature of the packaging device according to the invention, the arms of the second part of the rigid structural element have, on their face intended to come opposite a branch of the first part, lateral means for guiding said branch.

According to another additional feature of the packaging device according to the invention, the rigid structural element centrally includes a protruding element that extends on the side opposite that secured to the sheet of flexible material.

According to another additional feature of the packaging device according to the invention, the protruding element is secured to the first part of the rigid structural element, and passes through the second part through a central hole that the latter includes.

According to another additional feature of the packaging device according to the invention, the second part of the rigid structural element centrally includes a disk-shaped portion that constitutes the central planar part thereof.

According to another additional feature of the packaging device according to the invention, the first part of the rigid structural element includes snapping fingers, while the second part includes holes intended to receive said fingers so as to ensure the securing of said parts.

According to another additional feature of the packaging device according to the invention, the branches of the first part of the rigid structural element each include, on the side opposite that secured to the sheet of flexible material, at least one embrittlement area intended to facilitate its design.

According to another additional feature of the packaging device according to the invention, the tie is joined with blocking means, designed able to maintain the clamping.

The advantages and features of the packaging device according to the invention will emerge more clearly from the following description relative to the appended drawing, which shows several non-limiting embodiments thereof.

Figure 8A:
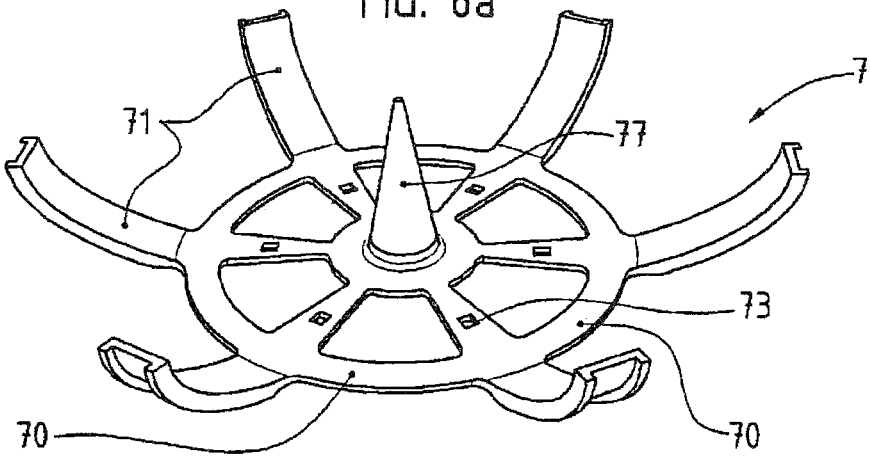
Figure 8B:
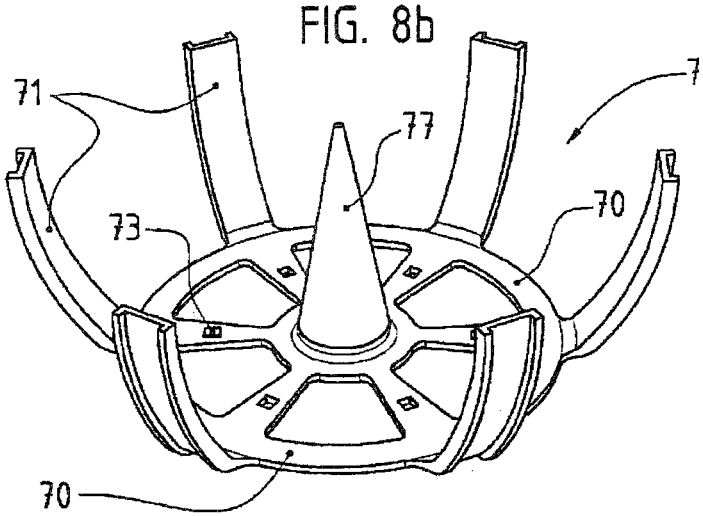
Figure 8C:
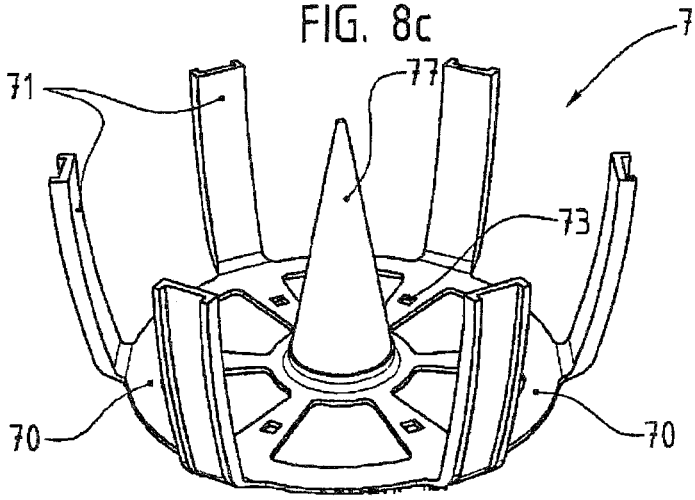

FIGS. 8*a*, 8*b* and 8*c* show diagrammatic perspective views of alternatives of part of the vase device according to the invention.

Figure 1:
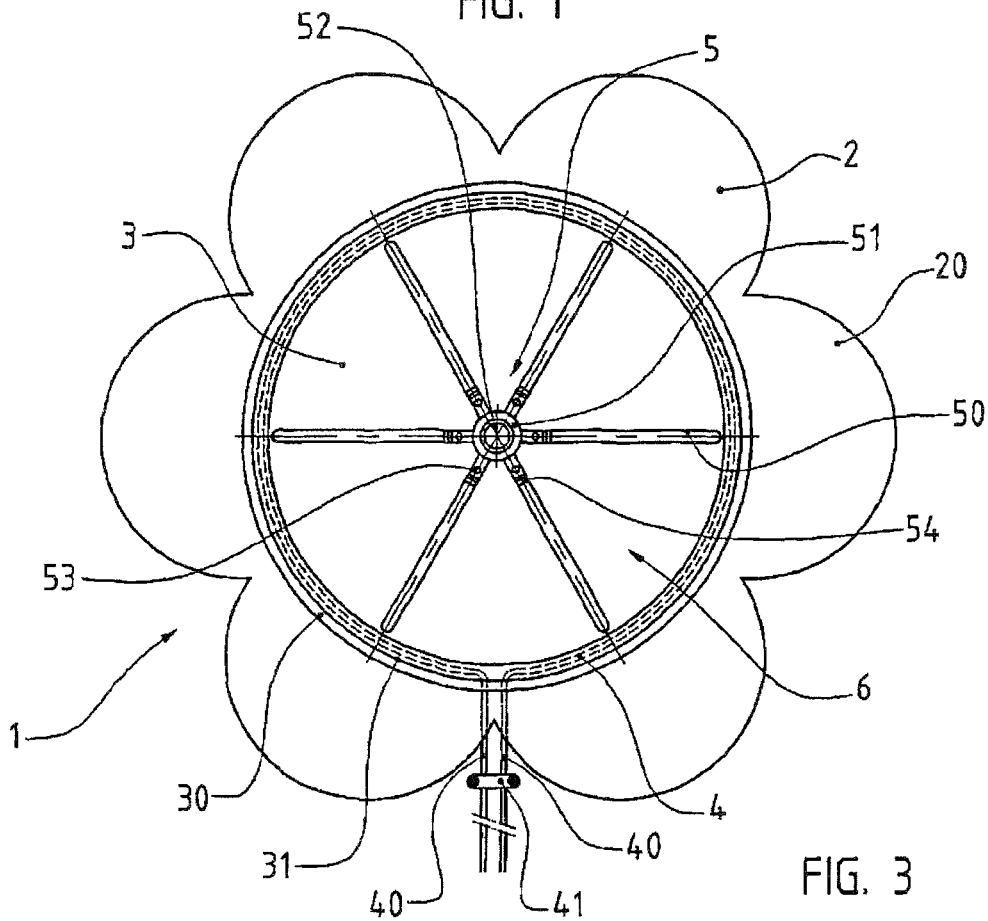
FIG. 1 shows a diagrammatic planar view of part of the packaging device showing the lower part of the vase device according to the invention.
Figure 2:
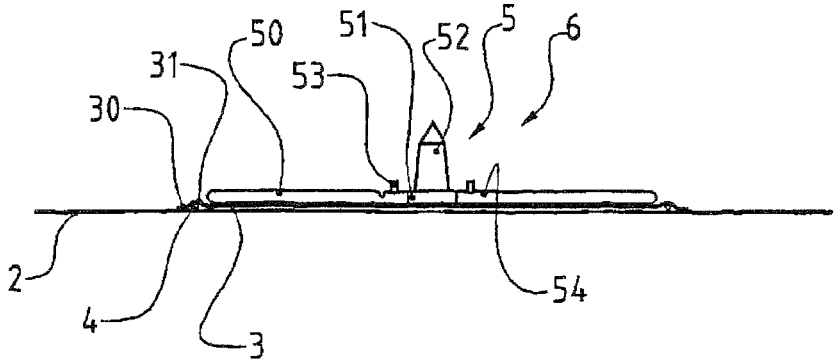
FIG. 2 shows a diagrammatic elevation view of the same part of the same device.

FIGS. 1 and 2 show that a packaging device 1 according to the invention, in this particular embodiment, includes on the one hand a sheet 2 made from a flexible material provided with decorations, in this case its peripheral part 20 is dimpled; on the other hand a sheet 3 made from a flexible material, with transverse dimensions smaller than those of the sheet 2, secured to the latter by its peripheral edge 30 so as to form a sheath 31 in which a clamping tie 4 is passed; additionally the first part 5 of a rigid structural element 6, designed in a star comprising branches 50, in this case and non-limitingly six branches, extending radially from a central disk 51, said first part 5 being coaxially secured to the sheet 3, while the free ends of the branches 50 are arranged substantially at the shaft 31.

The part 5 can be secured to the flexible sheet 3 in different ways, for example by welding or adhesion.

Figure 3:
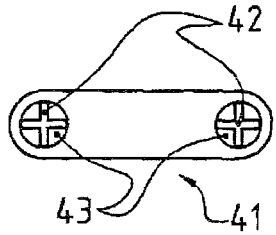
FIG. 3 shows a diagrammatic planar view of a detail of FIG. 1.

It will be noted that the two end parts 40 of the tie 4, which extend to the outside of the shaft 31, are kept in a blocking piece 41 shown in FIG. 3, and which includes two holes 42, one for each of the end parts 40, provided with flexible strips 43, which limit the movements of the tie 4.

In one alternative not shown, the blocking piece 41 is replaced by blocking means created at the end of one of the branches 50, and molded with the part 5.

Figure 4:
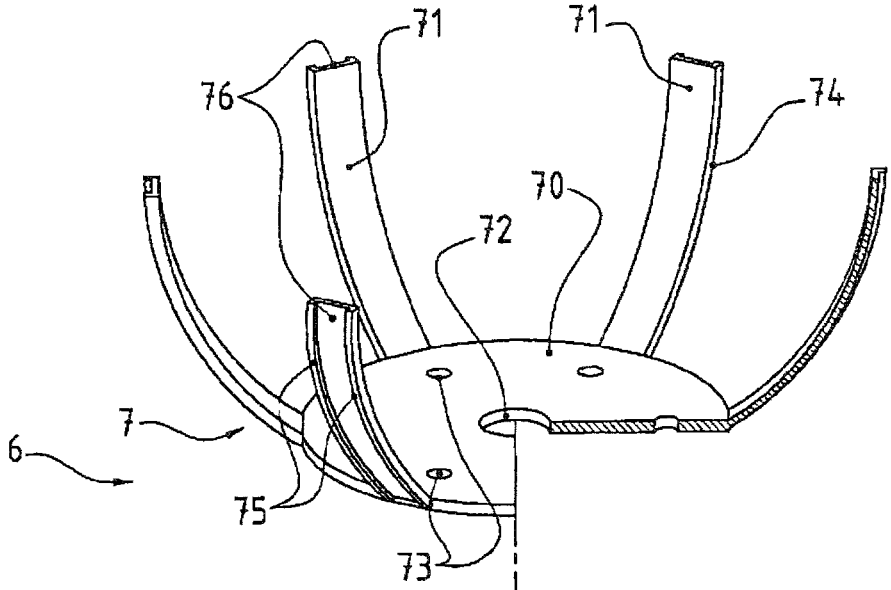
FIG. 4 shows an exploded diagrammatic perspective view with a partial cutaway of part of the same device.

FIG. 4 shows that the rigid structural element 6 includes, in addition to the first part 5, a second part 7 that has a flat disk-shaped central part 70, and arms 71 with a smaller length than that of the branches 50, which extend radially and are spaced away from the plane of the flat part 70. In the case at hand, the arms 71 have an arc of circle profile, and a flared shape, and contribute to giving the device 1 its shape, and defining its volume.

The second part 7 is intended to be secured coaxially to the first part 5, and to that end it includes a central hole 72 while the central disk 51 includes a protruding stud 52, which can be inserted into the central hole 72, and making it possible in particular to center the two parts.

Furthermore, the branches 50 each include, on the side opposite that secured to the sheet 3, not shown, an anchoring finger 53 intended to be inserted into one of the holes 73 formed on the periphery of the disk 70, each opposite an arm 71, so that when the parts 5 and 7 are secured to one another, the branches 50 are at the arms 71.

Figure 5:
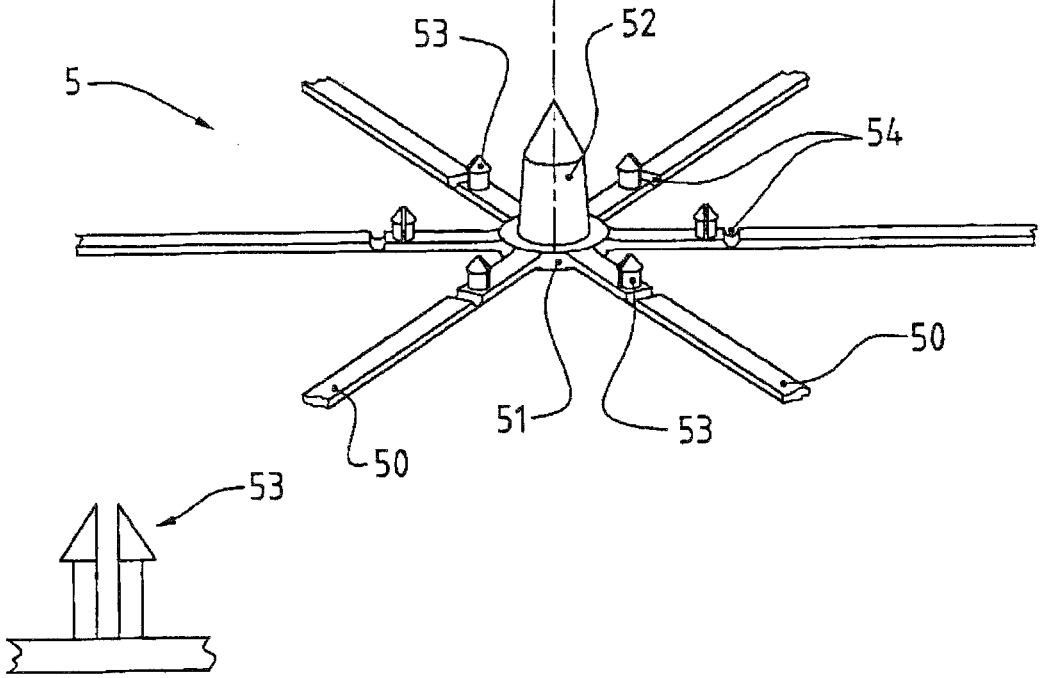
FIG. 5 shows a diagrammatic elevation view of a detail of FIG. 4.

It will be noted, in reference to FIG. 5, that each of the anchor fingers 53 has a deformable harpoon profile enabling it to be secured by snapping.

It will also be noted that the branches 50 each include, on their side opposite that secured to the sheet 3, and at a distance from the center equal to that of the radius of the disk 70, a thinner area 54.

Figure 6:
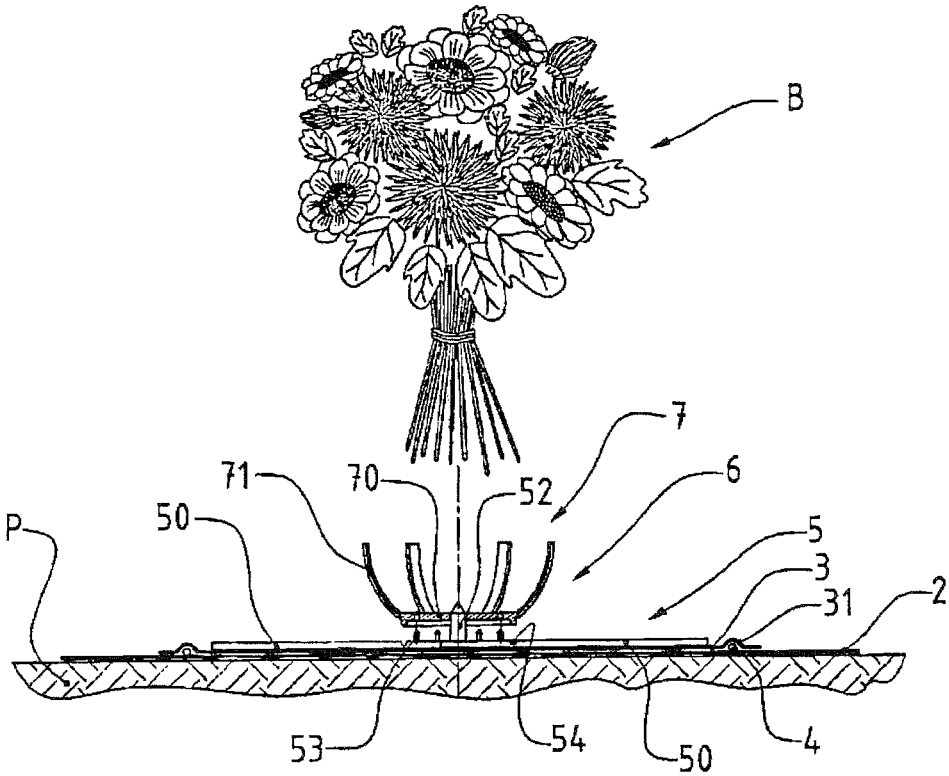
FIG. 6 shows an exploded elevation view of the device according to the invention, in the implementation phase.

FIG. 6 shows that the implementation of the packaging device 1 according to the invention, to produce a vase, first consists of arranging the sheet 2, provided with the sheet 3, which in turn is provided with the first part 5 of the rigid structural element 6, on a plane P, then securing the fingers 53 by snapping, the second part 7 to the first part 5, then positioning the bouquet B to be packaged whereof the stems are bound, by engaging its base on the stud 52. In this position, the bouquet B remains vertically in place, the stud 52 being sized to that end, which allows the operator to release it to continue the shaping operation of the device 1.

Then, by pulling on the end parts 40, not visible, of the tie 4, while maintaining the blocking piece 41, also not visible, one tightens the sheet 3, and therefore cinches the branches 50.

Because of the thinner areas 54, the branches 50 fold in that location, so that the middle part of the first part 5, inside those areas 54, is not subject to the deformation, and remains flat, to ensure the stability of the packaging device after it is shaped.

For the parts of the branches 50 that extend beyond the areas 54, it is necessary to differentiate between the portion 55 that comes into contact with an arm 71 of the second part 7, and the end portion 56 that overhangs the arm 71 lengthwise, the portions 55 and 56 being able, for example and non-limitingly, to be the same length.

Under the effect of tightening the tie 4, the portion 54 comes into contact with the arm 71 and fits the flared shape thereof. It will be noted in this respect that advantageously, the arms each include, on their outer face 74 against which the portion 54 of a branch 50 is intended to come into contact, lateral ribs 75 that create a slot 76 with a width larger than that of a branch 50, and which form guide means making it possible to prevent the branches 50 from escaping.

Figure 7:
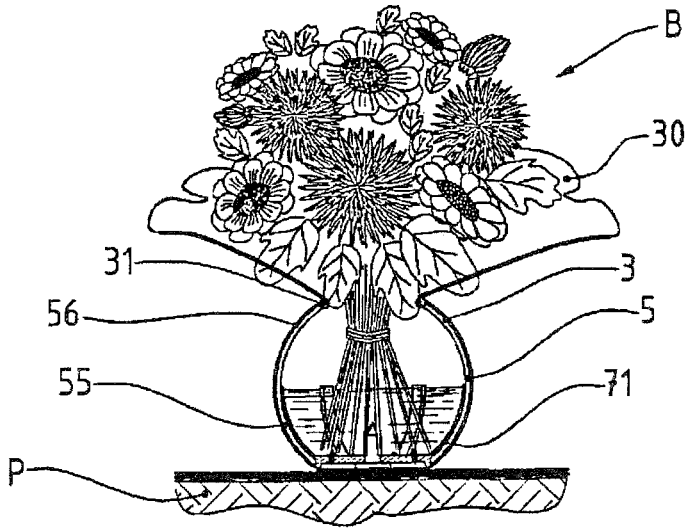
FIG. 7 shows a diagrammatic cross-sectional elevation view along a median vertical plane of the same device in the in-use phase.

In continuing to tighten the tie 4, the end portions 56 that are not contained by the arms 71 are cinched inwardly, which makes it possible to give the device 1 its shape and volume, as shown in FIG. 7.

The final shape of the device 1 depends on the shape of the arms 71 of the second part 7, but also the difference in length between the branches 50 and the arms 71, as well as the location of the shaft 31.

It will be noted that in this embodiment, the part 7 includes six arms 71, or as many as there are branches 50, but it is entirely possible for the number of branches 50 be larger than the number of arms 71, the important part being that the angular gaps can make it possible to associate a branch 50 with each arm 71. It is thus possible to associate a part 7 with six arms 71 with a part 5 with twelve branches 50, every other one being cinched by the arms 71, the others being cinched by the sheet 3, which then gives the packaging produced an original shape.

Of course, in the case of a bouquet B of fresh flowers, the flexible sheet 3 is made from a watertight material, so as to allow the packaging device 1 to be filled.

FIGS. 8*a*, 8*b* and 8*c* show alternatives of the second part 7, where the arms 71 have different curve radii, as well as different flare angles, which makes it possible to design devices 1 with varied shapes.

Advantageously, these different second parts 7 can be used with a same first part 5, which limits the quantities of parts to be stored.

It will be noted that the second parts centrally have a conical stud 77, instead of the hole 72, intended to act as centering device for the bouquet in place of the stud 52.

It will also be noted that it is of course possible, and advantageous, to multiply the number of arms 71 and branches 50, so as to obtain a device 1 with a refined shape.

It will also be noted that the packaging device 1 according to the invention can include only the sheet 3, but it may also include several sheets 2, and that the sheet 3 as well as the sheet(s) 2 can have different dimensions, for esthetic reasons.

Lastly, it will be noted that according to one alternative that is not shown, the ends of the branches 50 are provided with a transverse orifice, formed directly in the branch 50, or make up a hook-shaped element, allowing the passage of the tie 4. This alternative makes it possible to do away with the operation for producing a sheath 31, and also the need to use two sheets.

Of course, the packaging device according to the invention is in particular intended to produce a container serving as a vase, but it can also be used to package various objects.

The invention claimed is:

1. A packaging device forming a container comprising a formable rigid structural element (6), joined to a sheet of flexible material (3) provided at the periphery with means for retaining a clamping tie (4), characterized in that said rigid structural element (6) has two parts (5, 7), a first part (5) that comprises a multiplicity of radial branches (50), and which is made from a material allowing said branches (50) to be cinched, and a second part (7) made of rigid material, which centrally has a flat portion (70) and at its periphery radial arms (71) of which there are fewer than or the same number as said branches (50), said radial arms (71), which are shorter than said branches (50), are designed to define the shape and volume of the container and to that end they each have an end part which diverges from the plane of said central planar part (70) by flaring, said first and second parts (5, 7) being provided with means (53, 73) for securing to one another such that they are coaxial with one another, and such that said branches (50) are in line with said arms (71); and in that at one of the faces the flexible sheet (3) is secured to said first part (5) by its face opposite that intended to accommodate the second part (7).

2. The packaging device according to claim 1, characterized in that the flexible sheet (3) is made from a watertight material.

3. The packaging device according to claim 1, characterized in that it also includes at least one second sheet of flexible material (2), secured to the first sheet (3), on the face opposite that which is secured to the first part (5) of the rigid structural element (6).

4. The packaging device according to claim 3, characterized in that the second sheet (2) is secured to the first sheet (3) so as to form, on the periphery (30) of said first sheet (3), a sheath (31) intended to make up the means for retaining a clamping tie (4).

5. The packaging device according to claim 1, characterized in that the branches (50) of the first part (5) of the rigid structural element (6) each include, near their end, a transverse conduit constituting one of the retaining means of the clamping tie (4).

6. The packaging device according to claim 1, characterized in that the arms (71) of the second part (7) of the rigid structural element (6) have, on their face intended to come opposed to a branch (50) of the first part (5), lateral means (75) for guiding said branch (50).

7. The packaging device according to claim 1, characterized in that the rigid structural element (6) centrally includes a protruding element (52; 77) that extends on the side opposite that secured to the sheet of flexible material (3).

8. The packaging device according to claim 7, characterized in that the protruding element (52) is secured to the first part (5) of the rigid structural element (6), and passes through the second part (7) through a central hole (72) that the latter includes.

9. The packaging device according to claim 1, characterized in that the second part (7) of the rigid structural element (6) centrally includes a disk-shaped portion (70) that constitutes the central planar part thereof.

10. The packaging device according to claim 1, characterized in that the first part (5) of the rigid structural element (6) includes snapping fingers (53), while the second part (7) includes holes (73) intended to receive said fingers (53) so as to ensure the securing of said parts (5, 7).

11. The packaging device according to claim 1, characterized in that the branches (50) of the first part (5) of the rigid structural element (6) each include, on the side opposite that secured to the sheet of flexible material (3), at least one embrittlement area (54) intended to facilitate its design.

12. The packaging device according to claim 1, characterized in that the tie (4) is joined with blocking means (41), designed able to maintain the clamping.

13. The packaging device according to claim 12, characterized in that the blocking means are formed at the end of a branch (50), and are molded with the first part (5) of the rigid structural element (6).

* * * * *